US008851414B2

(12) United States Patent
Seong et al.

(10) Patent No.: US 8,851,414 B2
(45) Date of Patent: Oct. 7, 2014

(54) BOBBIN

(76) Inventors: HyunSoo Seong, Pyeongtaek-si (KR); Hyun-Guk Seong, Pyeongtaek-si (KR)

( * ) Notice: Subject to any disclaimer, the term of this patent is extended or adjusted under 35 U.S.C. 154(b) by 357 days.

(21) Appl. No.: 13/259,591

(22) PCT Filed: Jun. 3, 2010

(86) PCT No.: PCT/KR2010/003574

§ 371 (c)(1),
(2), (4) Date: Sep. 23, 2011

(87) PCT Pub. No.: WO2010/140850

PCT Pub. Date: Dec. 9, 2010

(65) Prior Publication Data

US 2012/0286086 A1 Nov. 15, 2012

(30) Foreign Application Priority Data

Jun. 5, 2009 (KR) ..... 10-2009-0049697

(51) Int. Cl.
*B65H 75/14* (2006.01)
*B65H 75/00* (2006.01)
*B65H 49/38* (2006.01)

(52) U.S. Cl.
CPC ..... *B65H 75/14* (2013.01); *B65H 75/00* (2013.01); *B65H 49/38* (2013.01); *B65H 2701/535* (2013.01)
USPC ..... 242/614; 242/588.2; 242/118.4

(58) Field of Classification Search
CPC ..... B65H 49/38; B65H 75/00; B65H 75/14; B65H 75/18; B65H 2701/535
USPC ..... 242/405.2–405.3, 407, 588, 588.2, 600, 242/611–611.1, 614–614.1, 118.4, 129
See application file for complete search history.

(56) References Cited

U.S. PATENT DOCUMENTS

| | | | | |
|---|---|---|---|---|
| 6,431,489 | B1 * | 8/2002 | Rose | 242/405.2 |
| 6,497,381 | B2 * | 12/2002 | Rose | 242/402 |
| 6,902,130 | B1 * | 6/2005 | Salem | 242/395 |
| 7,066,425 | B2 * | 6/2006 | Cornier et al. | 242/614 |
| 2002/0153446 | A1 * | 10/2002 | Rose | 242/402 |
| 2004/0188560 | A1 | 9/2004 | Cornier et al. | |

FOREIGN PATENT DOCUMENTS

| | | | |
|---|---|---|---|
| JP | 11-029262 | A | 2/1999 |
| JP | 2005-511446 | A | 4/2005 |
| JP | 2006-111418 | A | 4/2006 |
| KR | 20-1995-0006334 | U | 3/1995 |

OTHER PUBLICATIONS

Machine Translation of JP 2006-111418 A, Apr. 27, 2006.*
Machine Translation of JP 11-029262 A, Feb. 2, 1999.*

* cited by examiner

*Primary Examiner* — William E Dondero
(74) *Attorney, Agent, or Firm* — Birch, Stewart, Kolasch & Birch, LLP

(57) ABSTRACT

A bobbin includes an anti-rolling unit capable of supporting the bobbin to prevent the bobbin from rolling on a floor. The bobbin includes a cylindrical part around which a wire is wound, flanges provided at left and right sides of the cylindrical part, a through hole defined through a central portion of the cylindrical part and central portions of the left and right flanges, a handle part including a pair of support shafts, which protrude so as to be fitted into the through hole from left and right flanges, and left and right support rods having end portions fixed to the support shafts, respectively, and extending in parallel to the left and right flanges while making contact with outer surfaces of the right and left flanges, and an anti-rolling unit for the bobbin.

2 Claims, 6 Drawing Sheets

BOBBIN

TECHNICAL FIELD

The present invention relates to a bobbin. More particularly, the present invention relates to a bobbin structure including an anti-rolling unit capable of supporting the bobbin to prevent the bobbin from rolling on a floor.

BACKGROUND ART

The bobbin has been used for a long time to store a fiber, a wire or the like by winding the fiber, the wire, or the like around the bobbin. In addition to light objects such as fiber, heavy objects such as metallic wires may be wound around the bobbin. Accordingly, if the metallic wire is wound around the bobbin, the whole weight of the bobbin may be significantly increased.

The bobbin includes a cylindrical part, around which a wire is wound, and a flange that has a diameter greater than that of the cylindrical part to prevent the wound wire from getting out of both sides of the cylindrical part. In other words, the wire is wound around the cylindrical part, and prevented from getting out of the cylindrical part by the flange so that the wire can be maintained in a wound state. For example, four bobbins 10, around which wires for electric discharge machining are wound, are received in a box 1 divided by four partitions 2 as shown in FIGS. 1 and 2.

Actually, in the market, a plurality of bobbins, around which electric discharge machining wires are wound, are packed in a box to be sold. If bobbins, around which wires are wound, have light weights, a user can simply lift the box of the bobbins by using a hand. However, if heavy metallic wires such as wires for electric discharge machining are wound around the bobbins, each bobbin may have the weight of at least several tens kilograms. In this case, the user cannot easily lift each bobbin. In addition, the user may have a significant difficulty when lifting the bobbin by putting the hand between a box wall and each bobbin. Further, when the bobbin is taken out of the box in use, the bobbin may be frequently placed on a floor. In this case, since the bobbin has a cylindrical shape and a heavy weight, the bobbin may be rolled, causing injury to the foot of the user.

DISCLOSURE

Technical Problem

Accordingly, the present invention has been made keeping in mind the above problems occurring in the prior art, and an object of the present invention is to provide a bobbin including dual anti-rolling units allowing a user to easily put the bobbin into a box or easily take the bobbin out of the box, and preventing the bobbin from being rolled even if the bobbin is put down on a floor.

Another object of the present invention is to provide a bobbin in which anti-rolling units for the bobbin are provided on both a handle of the bobbin and flanges of the bobbin, so that convenience and safety can be improved in use of the bobbin.

Technical Solution

In order to accomplish the objects, according to one aspect of the present invention, there is provided a bobbin including a cylindrical part around which a wire is wound, flanges provided at left and right sides of the cylindrical part, having diameters greater than a diameter of the cylindrical part, and having a plate shape, a through hole defined through a central portion of the cylindrical part and central portions of left and right flanges, and an anti-rolling unit for the bobbin. The anti-rolling unit for the bobbin includes a plurality of first regions and a plurality of second regions alternately formed on outer peripheral surfaces of the flanges having the plate shape, in which two adjacent first regions or two adjacent second regions make contact with a flat surface.

According to another aspect of the present invention, there is provided a bobbin including a cylindrical part around which a wire is wound, flanges provided at left and right sides of the cylindrical part, having diameters greater than a diameter of the cylindrical part, and having a plate shape, a through hole defined through a central portion of the cylindrical part and central portions of the left and right flanges, a handle part having a substantially "ㄷ" shape and including a pair of support shafts, which protrude so as to be fitted into the through hole from left and right flanges, and left and right support rods having end portions fixed to the support shafts, respectively, and extending in parallel to the left and right flanges while making contact with outer surfaces of the right and left flanges, and an anti-rolling unit for the bobbin. The anti-rolling unit includes a first anti-rolling unit having a plurality of first and second regions alternately formed on outer peripheral surfaces of the flanges having the plate shape, in which two adjacent first regions or two adjacent second regions make contact with a flat surface, and a second anti-rolling unit defined as the handle makes contact with the flat surface.

In addition, one of the first and second regions includes concave parts, and a remaining one of the first and second regions includes convex parts alternately aligned with the concave parts.

In addition, the bobbin further includes an anti-rotation protrusion for the handle part protruding from an inner surface of the handle part, and a plurality of grooves provided on an outer surface of each flange to receive the anti-rotation protrusion of the handle part.

Advantageous Effects

As described above, according to the present invention, a user can easily put the bobbin into the box or easily take the bobbin out of the box by using the handle part of the bobbin. In addition, even if the user puts the bobbin down on the flat surface, the bobbin can be prevented from being rolled by the first anti-rolling unit formed on the outer peripheral surface of the bobbin and the second anti-rolling unit formed on the handle part of the bobbin. Accordingly, the user can use the bobbin conveniently and safely.

BEST MODE

Mode for Invention

Figure 1:
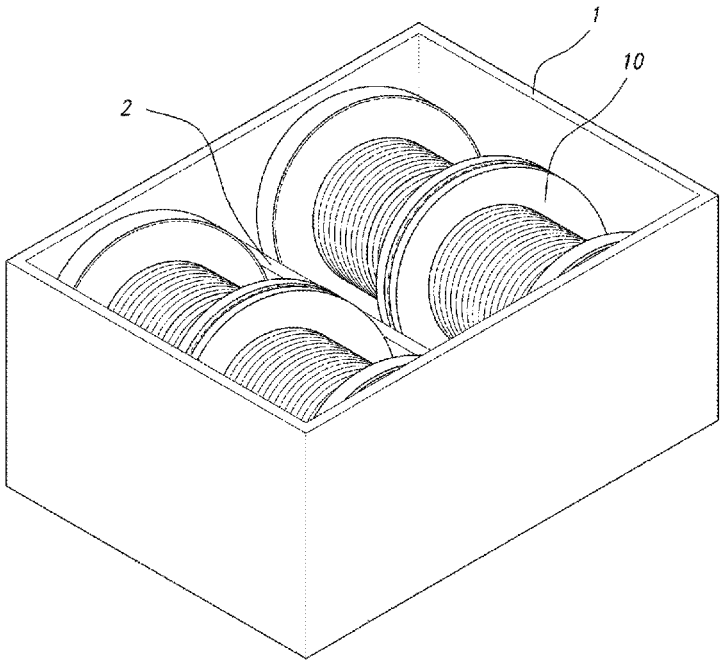
FIG. 1 is a perspective view showing a box without an upper portion in which the box contains bobbins according to the related art.
Figure 2:
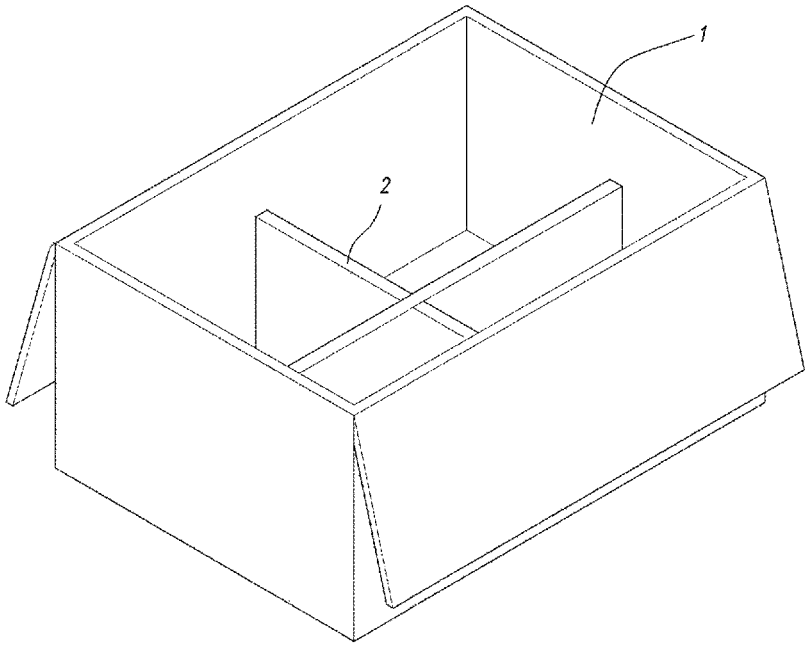
FIG. 2 is a perspective view showing the box containing bobbins according to the related art.
Figure 3:
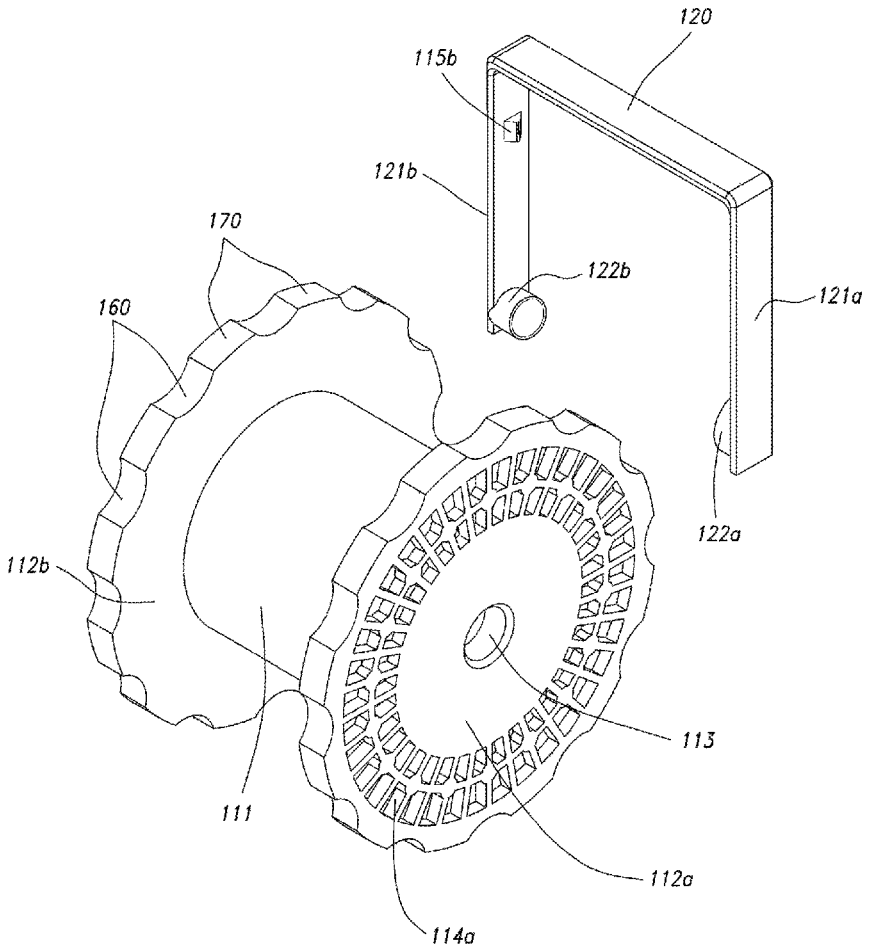
FIG. 3 is an exploded perspective view showing a bobbin according to the present invention.

As shown in FIG. 3, a bobbin 110 according to the present invention includes a cylindrical part 111, around which a wire is wound, flanges 112*a* and 112*b* formed both sides of the cylindrical part 111, and a through hole 113 formed at the central portion of the bobbin 110. A handle 120 is held by a user hand, and integrally formed with two support rods vertically extending from the handle 120, which include a right support rod 121*a* and a left support rod 121*b*, thereby forming a substantially "ㄷ" shape. The two support rods are provided at the inner surfaces thereof with support shafts 122*a* and 122*b* inserted into the through hole 130 and with anti-rotation protrusions 115*a* and 115*b* of the handle 120 fitted into grooves 114*a* and 114*b* formed on outer surfaces of the flanges 112*a* and 112*b*, respectively.

Therefore, after spreading the right and left support rods 121*a* and 121*b* of the handle 120 including an elastic member including plastic, the support shafts 122*a* and 122*b* and the anti-rotation protrusions 115*a* and 115*b* of the handle 120 are fitted into both sides of the through hole 113 and the grooves 114*a* and 114*b*, respectively.

Preferably, the support shafts 122*a* and 122*b* protruding from lower ends of the right and left support rods 121*a* and 121*b* are formed with a protrusion length of about 10 mm to about 20 mm while taking into the elasticity of the plastic handle 120 consideration without an influence on the assembling of the bobbin 120, so that the support shafts 122*a* and 122*b* can sufficiently endure the load of the wire wound around the bobbin 120 without getting out of the bobbin 110 due to the load of the wire.

Meanwhile, the anti-rotation protrusions 115*a* and 115*b* of the handle 120 are provided at upper ends of inner surfaces of the right and left support rods 121*a* and 121*b*, respectively. Each of the anti-rotation protrusions 115*a* and 115*b* has a protrusion length of about 3 mm and two tapered lateral surfaces.

Figure 5:
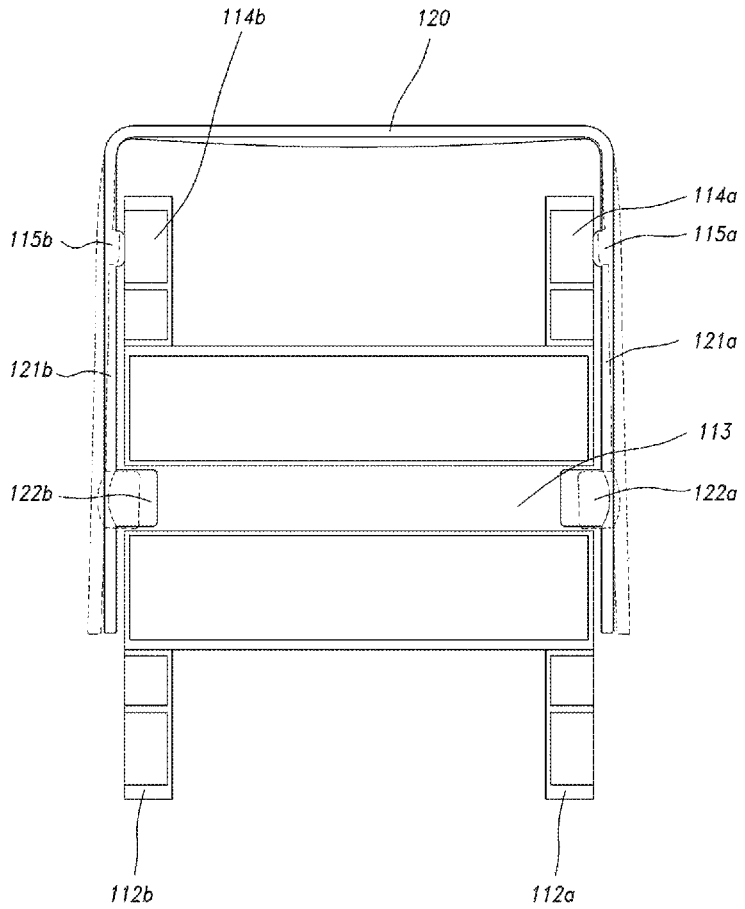
FIG. 5 is a sectional view showing the operation of anti-rotation protrusions provided in a handle of the bobbin according to the present invention.

The anti-rotation protrusions 115*a* and 115*b* are shorter than the right and left support shafts 122*a* and 122*b* having protrusion lengths of about 10 mm to about 20 mm and formed at lower ends of the inner surfaces of the right and left support rods 121*a* and 121*b*. The anti-rotation protrusions 115*a* and 115*b* have two tapered lateral surfaces. Therefore, the handle 120 of the bobbin 110 is easily rotated, so that the position of the handle 120 can be changed if necessary. When it is necessary to rotate the handle 120, the user slightly widens upper ends of the right and left support rods 121*a* and 121*b* using a hand as shown in FIG. 5, so that the handle 120 can be rotatable moved. Otherwise, the user forcibly pushes the handle 120 in the circumferential direction of the flanges 112*a* and 112*b*, so that the anti-rotation protrusions 115*a* and 115*b* can be moved from one groove to the adjacent groove.

In addition, each of the bobbin flanges 112*a* and 112*b* is provided on each outer peripheral surface thereof with a plurality of first regions 160 having a concave pattern and a plurality of second regions 170 having a convex pattern. The first and second regions 160 and 170 are alternately aligned with each other.

Since two adjacent second regions 170 interposed between the first regions 160 having concave patterns make contact with a flat surface when the outer peripheral surfaces of the flanges 112*a* and 112*b* of the bobbin 120 make contact with the flat surface, the first and second regions 160 and 170 serve as a first anti-rolling unit of the bobbin 120.

As a distance d, which is formed when two second regions 170 having convex patterns make contact with the flat surface, is increased, the rolling of the bobbin 120 is more prevented. However, according to the present invention, the distance d is in the range of about 20 mm to about 40 mm so that the rolling of the bobbin 120 can be prevented while the shape of the bobbin 120 is being maintained.

According to the present invention, in addition to the first anti-rolling unit formed on the outer peripheral surface of the wings 112*a* and 112*b* of the bobbin 110, the handle 120 serve as a second anti-rolling unit because the anti-rotation protrusions 115*a* and 115*b* are locked with the grooves 114*a* and 114*b*.

According to the present invention, the two adjacent second regions 170 make contact with a flat surface when the edges of the handle 120 make contact with the flat surface marked by a line 180, so that the bobbin 110 can be maintained in a stable attitude on the grounding surface. Accordingly, the bobbin 110 can be prevented from being easily rolled or moved.

Figure 4:
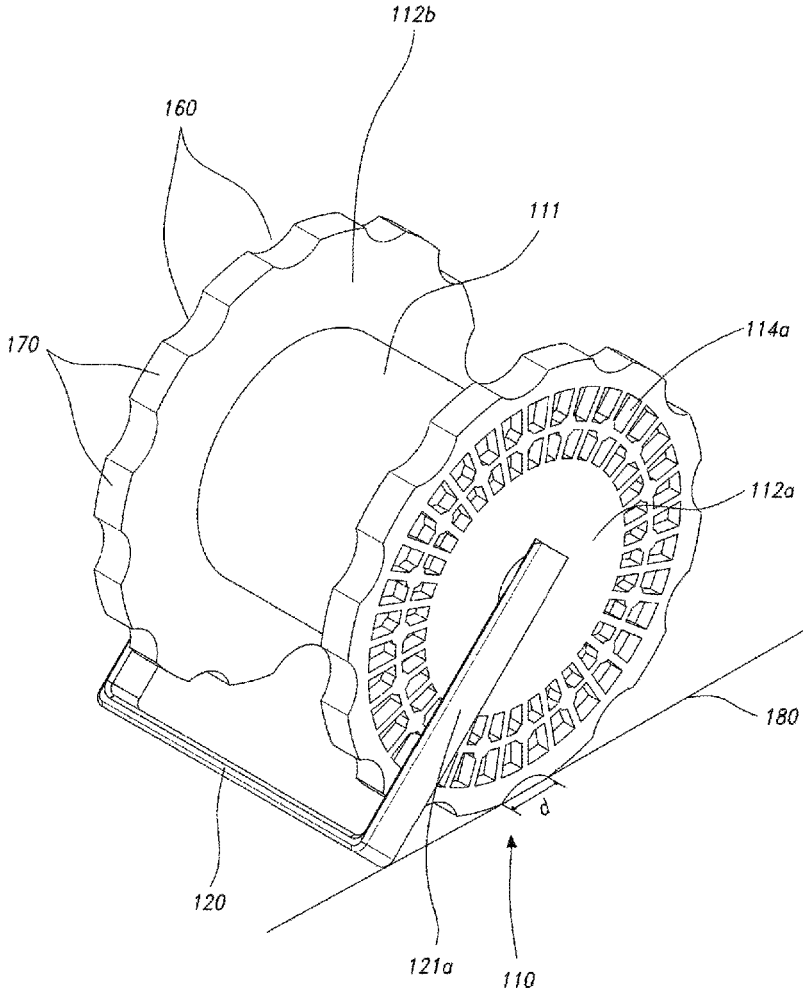
FIG. 4 is a perspective view showing the bobbin according to the present invention.
Figure 6:
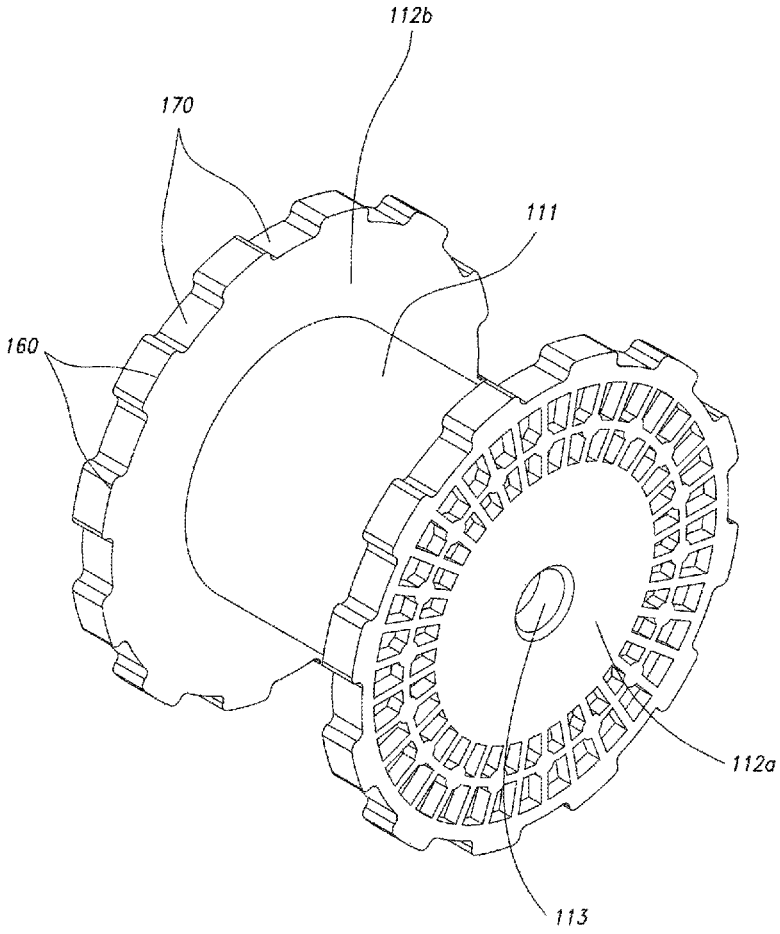
FIG. 6 is a perspective view showing another example of an outer peripheral surface of the flange in the bobbin according to the present invention.

The first and second regions 160 and 170 formed on the outer peripheral surfaces of the wings 112*a* and 112*b* of the bobbin 120 are not limited to the structure of FIG. 4, but may include the deformations of concave and convex patterns as shown in FIG. 6.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

INDUSTRIAL APPLICABILITY

The present invention is applicable for a bobbin around which a wire is wound, so that the above effects can be obtained.

The invention claimed is:

1. A bobbin comprising:

a cylindrical part around which a wire is wound;

flanges provided at left and right sides of the cylindrical part, having diameters greater than a diameter of the cylindrical part, and having a plate shape;

a through hole defined through a central portion of the cylindrical part and central portions of the left and right flanges;

a handle part having a substantially "ㄷ" shape and including a pair of support shafts, which protrude so as to be fitted into the through hole from left and right flanges, and left and right support rods having end portions fixed to the support shafts, respectively, and extending in parallel to the left and right flanges while making contact with outer surfaces of the right and left flanges;

an anti-rolling unit for the bobbin, wherein the anti-rolling unit includes a first anti-rolling unit having a plurality of first and second regions alternately formed on outer peripheral surfaces of the flanges having the plate shape, in which two adjacent first regions or two adjacent second regions make contact with a flat surface; and a second anti-rolling unit defined as the handle makes contact with the flat surface;

an anti-rotation protrusion for the handle part protruding from an inner surface of the handle part; and a plurality of grooves provided on an outer surface of each flange to receive the anti-rotation protrusion of the handle part.

2. The bobbin of claim 1, wherein one of the first and second regions includes concave parts, and a remaining one of the first and second regions includes convex parts alternately aligned with the concave parts.

* * * * *